US006740270B2

(12) United States Patent
Hwo et al.

(10) Patent No.: US 6,740,270 B2
(45) Date of Patent: May 25, 2004

(54) SPIN DRAW PROCESS OF MAKING PARTIALLY ORIENTED YARNS FROM POLYTRIMETHYLENE TEREPHTHALATE

(75) Inventors: Charles Chiu-Hsiung Hwo, Sugar Land, TX (US); Hoe Hin Chuah, Houston, TX (US); Houston Slade Brown, Houston, TX (US); Kailash Dangayach, Houston, TX (US); Paul Karol Casey, Katy, TX (US)

(73) Assignee: Shell Oil Company, Houston, TX (US)

( * ) Notice: Subject to any disclaimer, the term of this patent is extended or adjusted under 35 U.S.C. 154(b) by 321 days.

(21) Appl. No.: 09/970,117

(22) Filed: Oct. 3, 2001

(65) Prior Publication Data

US 2002/0130433 A1 Sep. 19, 2002

Related U.S. Application Data

(60) Provisional application No. 60/239,031, filed on Oct. 10, 2000.

(51) Int. Cl.[7] ..... D01D 5/084; D01D 5/098; D01F 6/62; D02G 3/02

(52) U.S. Cl. ..... 264/103; 264/210.7; 264/210.8; 264/211.12; 264/211.17

(58) Field of Search ..... 264/103, 210.7, 264/210.8, 211.12, 211.17

(56) References Cited

U.S. PATENT DOCUMENTS

| | | | |
|---|---|---|---|
| 3,584,103 A | 8/1971 | Harris | |
| 3,681,188 A | 8/1972 | Harris | |
| 5,645,782 A | 7/1997 | Howell et al. | |
| 5,662,980 A | 9/1997 | Howell et al. | |
| 5,698,146 A | 12/1997 | Schippers et al. | |
| 5,783,127 A | 7/1998 | Gross et al. | |
| 6,012,912 A | 1/2000 | Gross et al. | |
| 6,284,370 B1 * | 9/2001 | Fujimoto et al. | 428/364 |
| 6,287,688 B1 | 9/2001 | Howell et al. | |

FOREIGN PATENT DOCUMENTS

| | | |
|---|---|---|
| EP | 0745711 A1 | 4/1996 |
| EP | 1209262 A1 | 5/2002 |
| JP | 2000-239921 A | 9/2000 |
| WO | WO 01/66836 A1 | 9/2001 |

OTHER PUBLICATIONS

Patent Abstracts of Japan, vol. 2000, No. 26, Jul. 1, 2002 & JP 2001 254228 A (Asahi Kasei Corp), Sep. 21, 2001 Abstract.

International Search Report of Feb. 14, 2002.

* cited by examiner

*Primary Examiner*—Leo B. Tentoni
(74) *Attorney, Agent, or Firm*—Donald F. Haas

(57) ABSTRACT

This invention is a spin draw process for making partially oriented yarn from polytrimethylene terephthalate (PTT) which comprises the steps of:

(a) extruding and spinning PTT in forming a monofilament or multifilament yarn therefrom, (b) heating the yarn by contacting it with a first pair of godets moving at a speed in and at a temperature set to give a yarn temperature above the glass transition temperature and less than the cold crystallization temperature of PTT, (c) drawing the yarn between the first godet pair and a second pair of godets moving at a speed and a temperature of from 45 to 120° C. and having a draw ratio of 0.7 to 3.0, and (d) winding the yarns at the speed of 1 to 15% less than that of the second godet pair at a yarn temperature less than the glass transition temperature of PTT yarn.

40 Claims, No Drawings

SPIN DRAW PROCESS OF MAKING PARTIALLY ORIENTED YARNS FROM POLYTRIMETHYLENE TEREPHTHALATE

This application claims the benefit of U.S. Provisional Application No. 60/239,031 filed Oct. 10, 2000, the entire disclosure of which is hereby incorporated by reference.

FIELD OF THE INVENTION

This invention relates to the production of partially oriented yarns from polyesters, specifically polytrimethylene terephthalate. More specifically, the present invention is a spin draw process for making partially oriented yarn from polytrimethylene terephthalate.

BACKGROUND OF THE INVENTION

Partially oriented yarn (POY) is filament yarn in which the draw ratio is less than normal, i.e., less than that used to make fully oriented yarn (FOY), resulting in only partial longitudinal orientation of the polymer molecules. This necessary orientation can be created by normal drawing between godets or just by adjusting the speed of the first godet pair relative to that of the spinneret. Generally, in making POY from polyesters, especially polyethylene terephthalate (PET), the extruded or formed yarn goes through a free drop from a spinneret to a winder. This is the most economical process and it works well for PET because PET has a wide processing window, i.e., a winding speed of from 50 to 10,000 meters per minute. This type of process does not work well for polytrimethylene terephthalate (PTT) because it has a much narrower processing window, i.e., 500 to 4000 meters per minute. If the speed is higher than this, then the $T_g$ of the polymer increases. This makes it hard to establish stable conditions during the drawing process because the yarn is so sensitive to tension when it is formed from PTT.

Spin draw processes are generally used to make FOY. They generally comprise two or three pairs of godets which are generally heated to various degrees and between which the drawing of the yarn takes place. This type of process is not used to make POY because it is more expensive than the process described in the preceding paragraph.

SUMMARY OF THE INVENTION

This invention is a spin draw process for making partially oriented yarn from polytrimethylene terephthalate (PTT) which comprises the steps of:

(a) extruding and spinning PTT and forming a monofilament or multifilament yarn therefrom, (b) heating the yarn by contacting it with a first pair of godets (G1), moving at 1800, preferably 2000, to 3500 meters per minute at a temperature to give a yarn temperature of PTT above the glass transition temperature ($T_g$) and less than the cold crystallization temperature, ($T_{cc}$) of the PTT yarn.

(c) moving the yarn between the first godet pair and a second pair of godets (G2) moving at 1250, preferably 2450, most preferably 2560, to 4550 meters per minute and which is set at a temperature to give a yarn temperature of PTT of 45, preferably 60, to 120° C., preferably 100° C., most preferably less than 100° C., at a draw ratio (the ratio of speed of second godet pair to first godet pair (G2/G1) of 0.7 to 1.3, preferably less than 1.3, most preferably 0.95 to 1.28, and (d) winding the yarns at the speed of 1 to 15% less than that of the second godet pair (or third godet pair—G3) and at temperature less than the glass transition temperature of PTT yarn.

The process may be operated wherein the first pair of godets is moving at greater than 3500 meters per minute. Then the speed of the second pair of godets is from 2450, preferably 2560, to 10,000 meters per minute and the temperature of the second pair of godets should be set to give a yarn temperature of PTT from 80 to 180° C. and the draw ratio should be 0.7 to 3.0, preferably 0.7 to less than 3.0, most preferably 0.95 to 2.0.

The other desirable process utilizes three pairs of godets. The first set of godets is at room temperature. A small draw or no draw is achieved between the first two sets of godets. The second is heated and a major draw may occur between the second and the third pair of godets (G3). The third pair is also heated to stabilize the final POY package.

DETAILED DESCRIPTION OF THE INVENTION

A spin draw process is described herein for making POY from PTT. POY with a range of elongation and tenacity can be produced by varying spinning and drawing conditions (speeds, temperature, etc.). The purpose of using a spin draw machine to make PTT POY is to stabilize the fiber against shrinkage and to improve package stability and shelf life by developing a sufficiently high crystallinity and relax the stress built during drawing between godets using heated godets prior to winding.

The drawing process generally involves two or more pairs of godets. For example, Barmag, Toray, Murata, Zimmer, and Teijin Seiki spin draw machines may be used in making PTT POY. In this process a first pair of take-up godets (G1) is used to heat the yarn to a yarn temperature above the glass transition temperature ($T_g$) of PTT, generally greater than 45° C., but lower than the cold crystallization temperature, $T_{cc}$, of PTT (generally less than 60 to 65° C.) such that the fiber can be drawn between the first pair (G1) and a second pair of godets (G2). The precise temperature for pair (G1) will depend on the machine used and is determined by the speed and diameter of the godet and the number of wraps on the godet. The second pair of godets (G2) should be at a higher temperature than that of the first set of godets (G1), preferably to give a yarn temperature of 80 to 90° C. Again, the precise temperatures will depend on the speed and the diameter of the godets and the number of wraps on the godets. The yarn moves from the second pair of godets (G2) to the winder. The relative speeds of the godets and winder are:

(G1) less than, equal to, or greater than (G2) greater than or equal to Winder

A preferred process for carrying out the invention utilizes three pairs of godets. The first pair of godets (G1) is at room temperature, the second (G2) is heated and achieves a small draw, or no draw, and the third (G3) puts the majority of the draw (if there is to be any drawing at all between the godet pairs) into the yarn with drawing between the second (G2) and third godet pair (G3). This third godet pair (G3) is heated to stabilize the final POY package. In this case, the relative speeds of godets and winder are:

(G1) less than or equal to (G2) less than, equal to, or greater than (G3) greater than or equal to Winder In this situation where there is to be no draw, the draw ratio between the first two pairs of godets (the ratio of speed of the second godet pair to the first godet pair) should be from 0.3, preferably 0.7, most preferably 0.95, to 1.0 and the temperature of the second pair of godets should be set to give a yarn temperature of PTT above the glass transition temperature ($T_g$) and below the cold crystallization temperature ($T_{cc}$) of PTT yarn. If a small draw between the first two pairs of godets is desired, then the draw ratio may be increased up to 1.05. The draw ratio between the second and third pair of godets should be from 0.7 to 1.3, preferably 0.95 to 1.28, and the temperature of the third pair of godets should be set to give a yarn temperature of PTT the same as the temperature of second pair of godets in the previous embodiment depending upon the speed of the godets as discussed above.

$T_g$ and $T_{cc}$ can be measured with a differential calorimeter (DSC). The procedure normally used with DSC is heating the yarn at 20° C./min. and making a temperature scan from −50° C. to about 260° C. The change in endothermic or exothermic response of the yarn is recorded. $T_g$ is the temperature at which the yarn begins to the endothermic change from glassy state to rubbery state (observed by the deflection of the line from the temperature scan of the calorimeter). $T_{cc}$ is the temperature when the exothermic change from the supercooling of the yarn due to cold crystallization becomes maximal (i.e., at the peak of the scan.) The yarn specimen for testing can be obtained from the yarns produced with the speed of the first set of godet pair set at the desired speed and the yarns wound on the first set of godet pair.

In another embodiment, the godet pairs used in this invention can be a godet and a follower instead of two godets. Oil mist would be used for slow speed and air bearing for speeds greater than 2000 meters per minute.

When the speed of the first pair of godets (or the second pair in the embodiment where three pairs of godets are used) is 1800, preferably 2000, to 3500 meters per minute, the draw ratio should be from 0.7 to 1.3, preferably less than 1.3, most preferably 0.95 to 1.28, because sufficient bulk (or crimp) can be generated using a draw texturing machine or any other type. This necessary orientation can be created by normal drawing between godets or just by adjusting the speed of the first godet pair relative to that of the spinneret. The temperature of the first pair of godets is set to give a yarn temperature of PTT above the glass transition temperature, 45° C. plus or minus 5 to 10° C., and below the cold crystallization temperature, 60–65° C. The speed of the second pair of godets is 1250, preferably 2450, most preferably 2560, to 4550 meters per minute and the temperature of the second pair of godets is set to give a yarn temperature of PTT from 45, preferably 60, to 120° C., preferably 100° C. and most preferably less than 100° C. This produces a yarn with an elongation of greater than 60 percent and a tenacity of less than 3.0 g/d.

When the speed of the first pair of godets is greater than 3500 meters per minute, then the draw ratio should be from 0.7 to 3.0, preferably less than 3.0, most preferably 0.95 to 2.0. The temperature of the first pair of godets is the same as above but the temperature of the second pair of godets is set to give a yarn temperature of PTT ranges from 80 to 180° C. The speed of the second pair of godets is 2450, preferably 2560, to 10,000 meters per minute. This produces a yarn with an elongation of greater than 20 percent and a tenacity of less than 5.0 g/d.

An example of typical operating conditions is shown below:

TABLE 1

| | Set to give yarn Temperature (°C.) | Speed (meters per minute) | Yarn Wraps |
|---|---|---|---|
| 1st godet pair | 50–55 | 1800–2500 | 6–9 |
| 2nd godet pair | 80–90 | 2800–3800 | 5–7 |
| Winder | Room | 2800–3600 | Yarn tension 0.03 g/Denier tension) |

The speed (draw) ratio is speed of $2^{nd}$ godet pair /speed of $1^{st}$ godet pair=1.2–1.7 and speed of $2^{nd}$ godet pair/speed of winder=1.01–1.10.

The key points in selecting the exact conditions to use on a particular machine and with a particular yarn are as follows. The temperature of the first pair of godets must be set to give a yarn temperature of PTT lower than the cold crystallization temperature of Tcc and greater than its glass transition temperature, Tg. The temperature of the first pair of godets is chosen depending on the diameter of the godet, the number of wraps, and the speed of the godet pair. The draw point of the filaments is controlled at the point of the last wrap just before leaving any godet pair. The speed of godet pair is chosen such that the yarn wraps are stable. The temperature of the next pair of godets develops the yarn morphology and stress relaxation such that it is stable against shrinkage. It also controls the yarn boiling water shrinkage. The relative speeds of the godet pairs, i.e., the draw ratio, control the elongation and the tenacity of the filaments.

The primary purpose of the process of the present invention is to prevent shrinkage of the POY package during winding and a stable package for long shelf life.

EXAMPLES

Spinning for POY

Polytrimethylene terephthalate chips used have 0.92 IV (grade CP509210) for all the examples: 1 through 8.

Chips were first dried in the dryer at a selected temperature and period of time to achieve the water content of less than 30 ppm. Chips were then automatically fed to a hopper connected to the extruder and extruded at a selected screw speed and set of zone temperatures. Through the extruder, the molten PTT was then transferred through a filter to a spin beam with a gear pump. Next, the molten PTT then passed through a spinneret with a pre-selected number of holes for desired yarn counts, e.g., 48, 36 or 24 as indicated in column 2 of Table 2. Thereafter, the molten continuous strings were passed through a quench cabinet at a preset draft or air flow e.g. 0.4–0.5 meter/sec. as indicated below, cooled for example at 29° C., and solidified into continuous filaments. The solid continuous filaments (or fibers) were then wrapped around the $1^{st}$ set of heated godets (G1) with a predetermined number of wraps as indicated in Table 2. At a location between the quench cabinet and the $1^{st}$ set of godets, a spin finish applicator was used to apply the oil to the filaments. Next, continuously, the filaments proceeded to the $2^{nd}$ set of heated godets again with a predetermined number of wraps (as indicated in Table 2). Thereafter, the filaments were wound on to a bobbin by a winder. When the bobbin reached the weight (for example, 14 Kg.), it was automatically doffed off from the winder as a POY package. The extrusion and spinning conditions are described as follows:

For Examples 1 through 6

Dryer: 130° C. for 4 hrs, target water (H2O) ppm: <30, actual: 35 to 45 ppm.

A low temperature heating medium, Dowtherm J manufactured by Dow Chemical (boiling point of 207° C.), was used.

Spinning Machine manufactured by Zimmer (Germany)/Teijin Seiki (Japan): A commercial spin draw machine with 24 positions and 8 ends per position. The extruder zone temperature is set at: 245, 250, 255, 255, 260° C.

Manifold: 250° C.

Spin pack/beam: 255° C.

Spin Finish: Takemoto 2471 (manufactured by Takemoto Chemical, Inc., Japan) at 0.4% OPU (oil pick up percentage).

Extruder (for PET): Single screw of L/D=24 and 14.85 cm in diameter.

Extruder: Single screw of L/D=24 and 14.85 cm in diameter.

Spinning Extruder Hopper capacity: 500 kg.

Bobbin Tube Size: 112 (inner diameter)×126 (outer diameter×125 mm (stroke length) and 150 mm tube length.

Gear Pump: 3.0 cc/revolution at 19 revolution/min.

Quench Air temperature/Flow Rate: 29° C./0.4–0.5 m/sec.

Winder was by Barmag's Craft (Birotor) Winder.

The conditions for the godets set 1 (G1) and, set 2 (G2) and for winder are listed in Table 2, examples 7 and 8.

The bobbins of POY produced with the above described process and examples 1 through 8 exhibit yarn properties which are very suitable for further processing into textured yarns with a variety of texturing machines. Fabrics can be made from such yarns for applications in textiles.

TABLE 2

| Example No. | Yarn Type/Count | | | Spin Temp. ° C. | G1/G2 Temp. ° C. | G1/G2 # wraps | G1/G2 Speed m/min | G2/G1 Speed ratio | Winder Speed m/min | Winder/G2 Speed ratio | Tenacity g/d | Elong. % | BWS % |
|---|---|---|---|---|---|---|---|---|---|---|---|---|---|
| 1 | A1. | POY | 105/48 | 255 | 55/80 | 8.5/5.5 | 2500/3150 | 1.26 | 3050 | 1.03 | 3.00 | 76.2 | 9.8 |
| 2 | A2. | POY | 200/48 | 255 | 55/80 | 8.5/5.5 | 2500/3150 | 1.26 | 3050 | 1.03 | 2.78 | 82.9 | 7.6 |
| 3 | A3. | POY | 105/36 | 255 | 55/80 | 8.5/5.5 | 2500/3150 | 1.26 | 3050 | 1.03 | 2.88 | 81.8 | 8.2 |
| 4 | B1. | POY | 83/24 | 255 | 50/80 | 7.5/4.5 | 2500/3150 | 1.26 | 3050 | 1.03 | 3.02 | 76.2 | 8 |
| 5 | B2. | POY | 85/24 | 255 | 50/80 | 7.5/4.5 | 2500/3050 | 1.22 | 2950 | 1.03 | 2.90 | 84.7 | 6 |
| 6 | B3. | POY | 85/24 | 255 | 50/80 | 7.5/4.5 | 2915/3600 | 1.23 | 3350 | 1.07 | 3.31 | 63.6 | 10 |
| 7 | C1. | POY | 175/48 | 258 | 55/90 | 8.5/5.5 | 2500/2800 | 1.12 | 2700 | 1.04 | 2.6 | 110 | ? |
| 8 | C2. | POY | 195/48 | 257 | 48/80 | 8.5/5.5 | 2500/3200 | 1.28 | 3230 | 1.01 | 3.02 | 81 | 10.7 |

Spinning Extruder Hopper capacity: 5.08 metric tons

Bobbin Tube Size: 112 (inner diameter)×126 (outer diameter×150 mm (stroke length).

Gear Pump: 2.4 cc/revolution at 22 revolutions per minutes×4 ports.

Quench Air temperature/Flow Rate: 29° C./0.4–0.5 meter/sec.

The winder was manufactured by Teijin Seiki—Model AW912.

For examples 1 through 6, neither the heating device for the space between the surface of the spinneret and the beginning of the quench cabinet nor the exhaust system is available in this area. The heating device is normally used to prevent the condensation or crystallization of by-products generated in the extrusion and melt transferring system under heat and released at the exit of the spinneret. An exhaust system, if installed, is to withdraw those by-products.

The conditions for the godets set 1 (G1) and set 2 (G2) and for winder are listed in Table 2, examples 1 through 6.

Examples 7 and 8

Dryer: 130° C. for 4 hrs, target water ($H_2O$) ppm: <30, actual: 35 to 45 ppm.

Low temperature heating medium (boiling point of 207° C.) was used.

Spinning Machine manufactured by Barmag, Germany: A pilot scale spin draw machine with one (1) position and 6 ends per position. Extruder Zone Temperatures were set at: 240/250/265/255° C.

Manifold: 250° C.

Spin pack/beam: 258° C.

Spin Finish: Lurol PT7087 (manufactured by Goulston Technologies, Inc., USA) at 0.4% OPU (oil pick up percentage).

We claim:

1. A spin draw process for making partially oriented yarn from polytrimethylene terephthalate comprising the steps of:

(a) extruding and spinning polytrimethylene terephthalate and forming a monofilament or multifilament yarn therefrom, (b) heating the yarn by contacting it with a first pair of godets moving at 1800 to 3500 meters per minute at a temperature set to give a yarn temperature above the glass transition temperature and less than the cold crystallization temperature of PTT yarn, (c) moving the yarn between the first godet pair and a second pair of godets, which is moving at 1250 to 4550 meters per minute and which is at a temperature to give a yarn temperature of 45 to 120° C., at a draw ratio of 0.7 to less than 1.3, and (d) winding the yarn at a speed of 1 to 15 % less than that of the second godet pair and at temperature less than the glass transition temperature of PTT yarn.

2. The process of claim 1 wherein the speed of the second pair of godets is from 2450 to 4550 meters per minute.

3. The process of claim 2 wherein the speed of the second pair of godets is from 2560 to 4550 meters per minute.

4. The process of claim 1 wherein the yarn temperature is from 45 to 100° C.

5. The process of claim 4 wherein the yarn temperature is from 60 to less than 100° C.

6. The process of claim 1 wherein the speed of the first godet pair is from 2000 to 3500 meters per minute.

7. The process of claim 1 wherein the draw ratio is 0.95 to 1.28.

8. A spin draw process for making partially oriented yarn from polytrimethylene terephthalate comprising the steps of:

(a) extruding and spinning polytrimethylene terephthalate and forming a monofilament or multifilament yarn therefrom, (b) heating the yarn by contacting it with a first pair of godets moving at greater than 3500 meters per minute at a temperature to give a yarn temperature above the glass transition temperature and less than the cold crystallization temperature of PTT yarn, (c) moving the yarn between the first godet pair and a second pair of godets, which is moving at 2450 to 10,000 meters per minute and which is at a temperature to give a yarn temperature of 80 to 180° C., at a draw ratio of 0.7 to 3.0, and (d) winding the yarn at a speed of 1 to 15 % less than that of the second godet pair and at temperature less than the glass transition temperature of PTT yarn.

9. The process of claim 8 wherein the speed of the second pair of godets is from 2560 to 10,000 meters per minute.

10. The process of claim 8 wherein the draw ratio is from 0.7 to less than 3.0.

11. The process of claim 10 wherein the draw ratio is from 0.95 to 2.0.

12. A spin draw process for making partially oriented yarn from polytrimethylene terephthalate comprising the steps of:

(a) extruding and spinning polytrimethylene terephthalate and forming a monofilament or multifilament yarn therefrom, (b) heating the yarn by contacting it with a first pair of godets at room temperature, (c) moving the yarn between the first godet pair and a second pair of godets moving at 1800 to 3500 meters per minute at a temperature to give a yarn temperature above the glass transition temperature and less than the cold crystallization temperature of PTT yarn and at a draw ratio of 0.3 to 1.0, (d) moving the yarn between the second godet pair and a third pair of godets, which is moving at 1250 to 4550 meters per minute and which is at a temperature to give a yarn temperature of 45 to 120° C., at a draw ratio of 0.7 to 1.3, and (e) winding the yarn at a speed of 1 to 15 % less than that of the third godet pair and at temperature less than the glass transition temperature of PTT yarn.

13. The process of claim 12 wherein the speed of the third pair of godets is from 2450 to 4550 meters per minute.

14. The process of claim 13 wherein the speed of the third pair of godets is from 2560 to 4550 meters per minute.

15. The process of claim 12 wherein the yarn temperature is from 45 to 100° C.

16. The process of claim 15 wherein the yarn temperature is from 60 to less than 100° C.

17. The process of claim 12 wherein the speed of the second godet pair is from 2000 to 3500 meters per minute.

18. The process of claim 12 wherein the draw ratio in (d) is 0.7 to less than 1.3.

19. The process of claim 18 wherein the draw ratio in (d) is 0.95 to 1.28.

20. The process of claim 12 wherein the draw ratio in (c) is 0.3 to 1.0.

21. The process of claim 20 wherein the draw ratio in (c) is 0.7 to 1.0.

22. The process of claim 21, wherein the draw ratio in (c) is 0.95 to 1.0.

23. A spin draw process for making partially oriented yarn from polytrimethylene terephthalate comprising the steps of:

(a) extruding and spinning polytrimethylene terephthalate and forming a monofilament or multifilament yarn therefrom, (b) contacting the yarn with a first pair of godets at room temperature, (c) moving the yarn between the first godet pair and a second pair of godets moving at 1800 to 3500 meters per minute at a temperature to give a yarn temperature above the glass transition temperature and less than the cold crystallization temperature of PTT yarn and at a draw ratio of above 1.0 up to 1.05, (d) moving the yarn between the second godet pair and a third pair of godets, which is moving at 1250 to 4550 meters per minute and which is at a temperature to give a yarn temperature of 45 to 120° C., at a draw ratio of 0.7 to 1.3, and (e) winding the yarn at a speed of 1 to 15 % less than that of the third godet pair and at temperature less than the glass transition temperature of PTT yarn.

24. The process of claim 23 wherein the speed of the third pair of godets is from 2450 to 4550 meters per minute.

25. The process of claim 24 wherein the speed of the third pair of godets is from 2560 to 4550 meters per minute.

26. The process of claim 23 wherein the yarn temperature is from 45 to 100° C.

27. The process of claim 26 wherein the yarn temperature is from 60 to less than 100° C.

28. The process of claim 23 wherein the speed of the second godet pair is from 2000 to 3500 meters per minute.

29. The process of claim 23 wherein the draw ratio in (d) is 0.7 to less than 1.3.

30. The process of claim 29 wherein the draw ratio in (d) is 0.95 to 1.28.

31. A spin draw process for making partially oriented yarn from polytrimethylene terephthalate comprising the steps of:

(a) extruding and spinning polytrimethylene terephthalate and forming a monofilament or multifilament yarn therefrom, (b) contacting the yarn with a first pair of godets at room temperature, (C) moving the yarn between the first godet pair and a second pair of godets moving at greater than 3500 meters per minute at a temperature to give a yarn temperature above the glass transition temperature and less than the cold crystallization temperature of PTT yarn and at a draw ratio of 0.3 to 1.0, (d) moving the yarn between the second godet pair and a third pair of godets, which is moving at 2450 to 10,000 meters per minute and which is at a temperature to give a yarn temperature of 80 to 180°C., at a draw ratio of 0.7 to 3.0, and (e) winding the yarn at a speed of 1 to 15 % less than that of the third godet pair and at temperature less than the glass transition temperature of PTT yarn.

32. The process of claim 31 wherein the draw ratio of step (d) is from 0.7 to less than 3.0.

33. The process of claim 32 wherein the draw ratio of step (d) is from 0.95 to 2.0.

34. The process of claim 31 wherein the draw ratio in (C) is 0.7 to 1.0.

35. The process of claim 34 wherein the draw ratio in (c) is 0.95 to 1.0.

36. The process of claim 31 wherein the speed of the third pair of godets is from 2560 to 10,000 meters per minute.

37. A spin draw process for making partially oriented yarn from polytrimethylene terephthalate comprising the steps of:

(a) extruding and spinning polytrimethylene terephthalate and forming a monofilament or multifilament yarn therefrom, (b) contacting the yarn with a first pair of godets at room temperature, (c) moving the yarn between the first godet pair and a second pair of godets moving at greater than 3500 meters per minute at a temperature to give a yarn temperature above the glass transition temperature and less than the cold crystallization temperature of PTT yarn and at a draw ratio of above 1.0 up to 1.05, (d) moving the yarn between the second godet pair and a third pair of godets, which is moving at 2450 to 10,000 meters per minute and which is at a temperature to give a yarn temperature of 80 to 180° C., at a draw ratio of 0.7 to 3.0, and (e) winding the yarn at a speed of 1 to 15 % less than that of the third godet pair and at temperature less than the glass transition temperature of PTT yarn.

38. The process of claim 37 wherein the speed of the third pair of godets is from 2560 to 10,000 meters per minute.

39. The process of claim 37 wherein the draw ratio in (d) is 0.7 to less than 1.3.

40. The process of claim 39 wherein the draw ratio in (d) is 0.95 to 1.28.

* * * * *